US005617134A

United States Patent [19]

Lamothe

[11] Patent Number: 5,617,134

[45] Date of Patent: Apr. 1, 1997

[54] MACHINE FOR MANIPULATING AND WORKING ON WEB MATERIAL

[75] Inventor: Richard P. Lamothe, Burlington, Conn.

[73] Assignee: Energy Saving Products and Sales Corporation, Burlington, Conn.

[21] Appl. No.: 488,508

[22] Filed: Dec. 7, 1995

Related U.S. Application Data

[63] Continuation-in-part of Ser. No. 218,512, Mar. 25, 1994, Pat. No. 5,505,401.

[51] Int. Cl.[6] ..... B41J 2/435

[52] U.S. Cl. ..... 347/264; 242/470.3; 242/525; 242/541.3; 242/564.5

[58] Field of Search ..... 242/413.3, 418, 242/418.1, 419.1, 419.5, 420.2, 420.3, 541.3, 559.4, 564.4, 564.5, 598.3, 525; 226/113, 118; 347/264

[56] References Cited

U.S. PATENT DOCUMENTS

| | | | |
|---|---|---|---|
| 3,524,369 | 8/1970 | Hoffmann | 242/564.4 X |
| 4,025,005 | 5/1977 | Fleck et al. | 242/413.3 X |
| 4,173,314 | 11/1979 | Curran et al. | 242/420.3 |
| 4,200,245 | 4/1980 | Bugnone | 242/533.8 X |
| 4,253,597 | 3/1981 | Waffner | 242/418.1 X |
| 4,729,522 | 3/1988 | Tafel et al. | 242/418.1 |
| 5,000,394 | 3/1991 | Wales et al. | 242/420.3 |
| 5,007,272 | 4/1991 | Matsunaga et al. | 242/419.5 X |
| 5,156,350 | 10/1992 | Wales et al. | 242/420.3 |

*Primary Examiner*—Michael R. Mansen
*Assistant Examiner*—William A. Rivera
*Attorney, Agent, or Firm*—McCormick, Paulding & Huber

[57] ABSTRACT

A roll-to-roll paper web feeding system for a laser printer. The paper web is unwound from a roll supported in the unwind machine by a single conveyor belt driven at a speed that varies to match the web feed to the speed of the printer. A pivotably mounted beam houses the belt and can be raised to permit replacement of the roll. A shock absorber acts between the beam and the machine frame to maintain contact between the belt and the paper roll. Replacement of the belt is facilitated by a unique latch acting on the support shaft for a sprocket at the free end of the beam provided for the belt. The paper web is rewound on a roll provided in the rewind machine. Tension must be kept high enough in the paper web to assure a tightly wrapped roll in the rewind machine. This fact requires a friction, or drag roller, to maintain at least one free loop of web, and this drag roller can be replaced quickly as a result of shifting it laterally to decouple the coupling provided at one end of the drag or friction roller. The rewind machine has an exposed straight run of web material across the top of the pivoted beam that carries the driven roller member. A printer and/or slitter is provided on this beam for slitting the web material and/or printing on selected portions of the web.

5 Claims, 8 Drawing Sheets

MACHINE FOR MANIPULATING AND WORKING ON WEB MATERIAL

CROSS REFERENCE TO RELATED APPLICATION

This application is a Continuation-in-Part of Ser. No. 218,512 filed Mar. 25, 1994, now U.S. Pat. No. 5,505,401 and having the same title and same applicant.

This invention relates generally to apparatus for supporting rolls of web material to be fed into or to be reclaimed from a utilization device. The utilization device may comprise a high speed laser printer of the type which operates at widely varying speed to print selected indicia on preprinted advertising material or the like.

BACKGROUND OF THE INVENTION

Prior art web feeding machines of the type adapted to handle rolls of preprinted paper for delivery to or reclamation from a laser printer have evolved into relatively complicated structures with all the inherent disadvantages of these complications. For example, the machine shown in prior art U.S. Pat. No. 5,000,394 includes an elevator structure for lifting the paper roll into position by means of a vertically mounted carriage including laterally movable arms for engage the end of the paper roll core. Changes in the speed of the paper web to accommodate changes in speed of the laser printer are also available and have taken the form of a tension free loop in the paper web between the printer and the paper roll. The paper roll is generally driven by a relatively short pair of belts provided in a pivoted arm structure that drives the roll peripherally to provide the web from the bottom of the roll, over a series of rollers to form the tension free loop. The speed of the belts is controlled by an ultrasonic detector so located as to sense the depth of the tension free loop. A control circuit uses this information to regulate the speed of the drive belts and hence the rate at which the web travels.

In a typical installation where paper web is to be fed at widely varying speeds to a laser printer unwind stands of this general type often require replacement of these drive belts. The present invention seeks to minimize the downtime required on such a machine by providing for expeditious replacement of such belts by reason of the fact that only one such belt is required in the unwind machine to be described, and also because the belt itself can be readily slackened to permits its removal for replacement purposes.

In machines for reclaiming or rewinding the paper web discharged from a laser printer or the like there is a need for providing a constant tension in the web material being rewound on the roll while at the same time maintaining a tension free loop between the rewind machine and the utilization device or laser printer. The paper roll in such a rewind machine is generally driven by one or more driven rollers rather than by drive belts. The present invention provides a unique path of travel for the web so as to maintain this tension in the web as it is rewound on the roll. An important feature of the present invention is that the paper web is wrapped around a significant peripheral portion of a friction roller provided in the machine for this purpose. The friction roller permits at least one tension free loop to be formed between the laser printer and the rewind machine without sacrificing the tension in the paper web between such friction roller and the roll of paper being rewound. Such friction rollers tend to wear however, and hence removal of the friction roller for replacement or for repair is often necessary. The machine to be described meets this need.

Among the objects of the present invention then are to provide a less complicated, less expensive machine for winding, and a machine for rewinding paper, fed to or received from a utilization device such as a laser printer. Since the paper rolls normally handled by such machines are quite heavy, on the order of 750 to 1500 pounds, it is generally necessary to provide for hydraulic hand trucks or the equivalent to move these paper rolls from one area of a typical printing installation to the vicinity of the laser printer. Furthermore, the typical hydraulic hand cart can be utilized to lift the paper rolls into or out of rewind and unwinder machines without the need for the machine itself providing a mechanism for lifting the roll. Recognition of this fact has led to the uncomplicated, and hence lower cost unwinder and rewind machines to be described.

Another important feature of the present invention can be traced to the accommodation of a conventional pneumatic air shaft for supporting the roll of paper in the machine frame. As a result of preassembling such a pneumatic roll core shaft with a paper roll prior to installation of the combination in the machine, the machine itself can be less complicated leading to less downtime and hence improves productivity for the overall combination of unwind machine laser printer and rewind machine.

Still another important feature of the present invention that relates particularly to the unwind machine involves taking advantage of the upper run paper web material traveling across the top of the pivoted beam .which supports the rotatable driven member for achieving rotation of the paper roll by engaging the roll's periphery. More particularly, this upper run exposes the printed paper web material as it travels from the utilization device to the unwind roll. Advantage is taken of the expanse of paper web material for the following purposes. First of all, a web slitter is provided on the pivoted beam for cutting the paper web material lengthwise and thereby providing not one paper web but several paper webs which can be wound in the same roll or which can be routed to other paper rolls adjacent to or in the same unwind machine itself. Also provided on the pivoted beam is a printer, which may be of the thermal type, and which is controlled by an encoder associated with the rollers guiding the web material entering the upper run provided near the top of the pivoted beam. By selective printing on the web material traveling across the upper run improvements can be made to achieve selective printing of the traveling web material.

SUMMARY OF THE INVENTION

In accordance with present invention a machine is provided for manipulating web material between a roll and a utilization means such as a laser printer. The machine comprises a frame including a base, and upright supports extending from the middle of the base. The base includes spaced vertically extending side walls that define horizontally spaced sockets for receiving the ends of a pneumatic roll core shaft. The ends of the shaft are preferably provided with bearings that are received in plastic blocks that define these spaced sockets. A variable speed drive is provided that includes a driven belt in the case of the unwind machine, and that includes a driven roller in the case of the rewind machine. The driven member engages the periphery of the roll for rotating the roll in the desired direction. The machine is designed to accommodate rotation in both the clockwise and counterclockwise direction. The driven belt or roller is supported in a movable structure mounted to the upright supports so that the driven belt or roller contacts the periphery of the roll to accommodate changes in the roll diameter. Means is provided for guiding the web during its movement between the utilization means and the roll from which it is unwound or on which it is being rewound, and this web guiding means includes a web tensioning roller having a substantial portion of its periphery defining a path for the web. Further, the web guiding means includes spaced web supporting rollers for creating a first tension free web loop. Ultrasonic sensing means is provided above the loop for detecting changes in the loop length, and control means responsive to said sensing means changes the speed of the variable speed drive means to maintain a predetermined loop length, or at least to maintain this loop length within predetermined limits.

Further features of the present invention are that the means for supporting the driven belt or roller comprises a pivoted beam supported on a horizontal axis defined at the top or the upright supports. The upright supports comprise posts which project upwardly from the side walls of the base.

Still another feature of the present invention can be traced to the means for selectively moving this pivoted beam upwardly away from the roll to permit removal or replacement of the roll of paper. In addition the unwind machine includes biasing means provided between the frame base and the pivoted beam to maintain appropriate contact pressure between the driven belt and the roll of paper.

In the rewind machine the roll of paper is driven by a single roller such that the web of paper withdrawn from the roll passes over a plate provided in the upper portion of the pivoted support beam. The paper web is provided around a major portion of the periphery of a drag or friction roller which maintains tension in the web between the roll of paper being rewound and a tension free loop of web material between the drag roller and the roll of paper. This drag roller is designed to be readily removed for replacement or repair by providing a coupling at one end of the roller and a spring loaded stub shaft fitted into a self aligning socket at the opposite end of the roller.

Still with reference to the paper roll rewind machine the provision of a single tension free loop may not provide sufficient accumulation of web material between the utilization device and the roll being rewound when the abrupt changes in speed characteristic of present day laser printers must be accommodated. Therefore, provision is made for a second tension free loop to provide an added margin of slack web material to accommodate abrupt start up speeds of the laser printer, all without the need for providing expensive vertically movable dancer roles or festoon type roller combinations to accommodate additional web material between the utilization device and the paper roll being rewound.

BRIEF DESCRIPTION OF THE DRAWINGS

A more complete understanding of the invention and many of the attendant advantages will be readily appreciated as the same becomes better understood by reference to the following detailed description when considered in conjunction with the accompanying drawings wherein.

DETAILED DESCRIPTION

Figure 1:
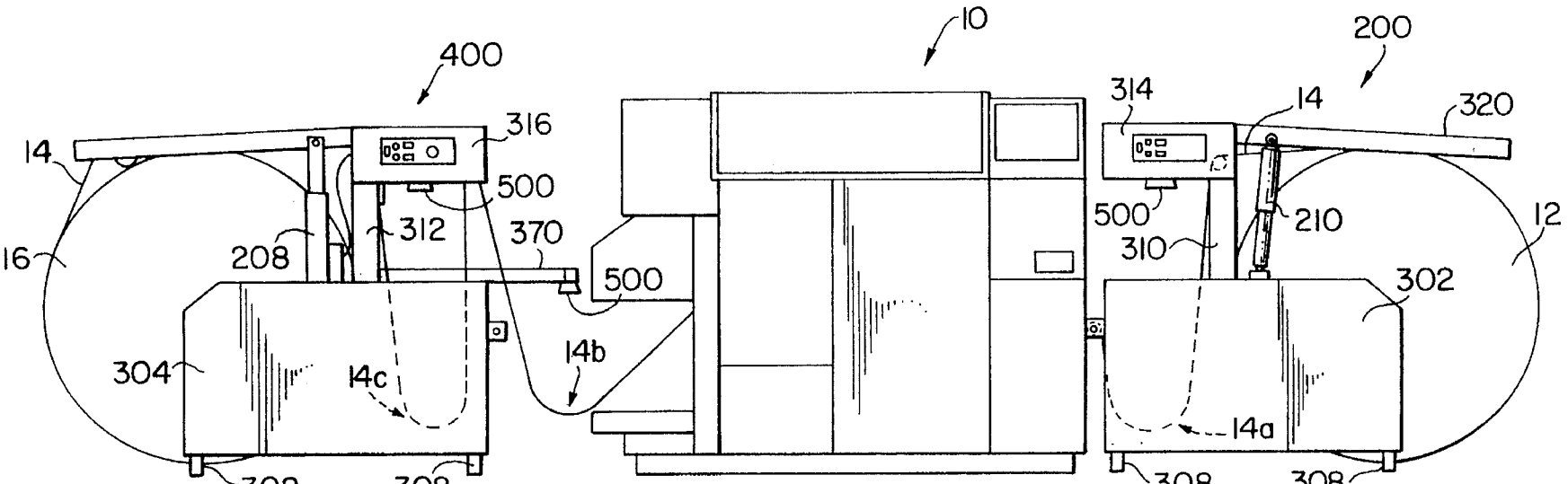
FIG. 1 shows in elevation a typical high speed laser printer provided between an unwind machine and a rewind machine of the present invention.

Turning now to the drawings in greater detail, FIG. 1 shows a utilization device in the form or a laser printer 10 of the type manufactured by Siemens. Such a printer is representative of utilization devices that must be provided with a continuous stream of web material, the printer being capable of moving the web material through the printer at a range of speeds including a stop condition sometimes necessary for internal purposes in connection with self cleansing or maintenance reasons designed in the laser printer by the manufacturer.

At the right hand side of FIG. 1 a paper roll 12 is shown rotatably supported in an unwind machine 200 to be described. This unwind machine 200 includes means for rotating the paper roll 12 for feeding the web of paper from the roll indicated generally at 14 into the laser printer 10. The unwind machine 200 includes provisions for forming a tension free loop 14*a* of the web material between itself and the laser printer 10.

The installation of FIG. 1 is a so-called roll to roll setup wherein the paper web material is initially provided on a paper roll 12 and downstream of the laser printer 10 is rewound on a paper roll 16 at the left hand side of the setup shown in a rewind machine 400. The paper web 14 moves through two tension free loops 14*b* and 14*c* between the laser printer 10 and the rewind machine 400. These loops 14*b* and 14*c* provide an accumulation of web material between the rewind machine and the paper roll. The paper web must be rewound under a significant tension however and drag or friction means is provided in the rewind machine to assure that the paper roll 16 is rewound compactly.

Figure 8:
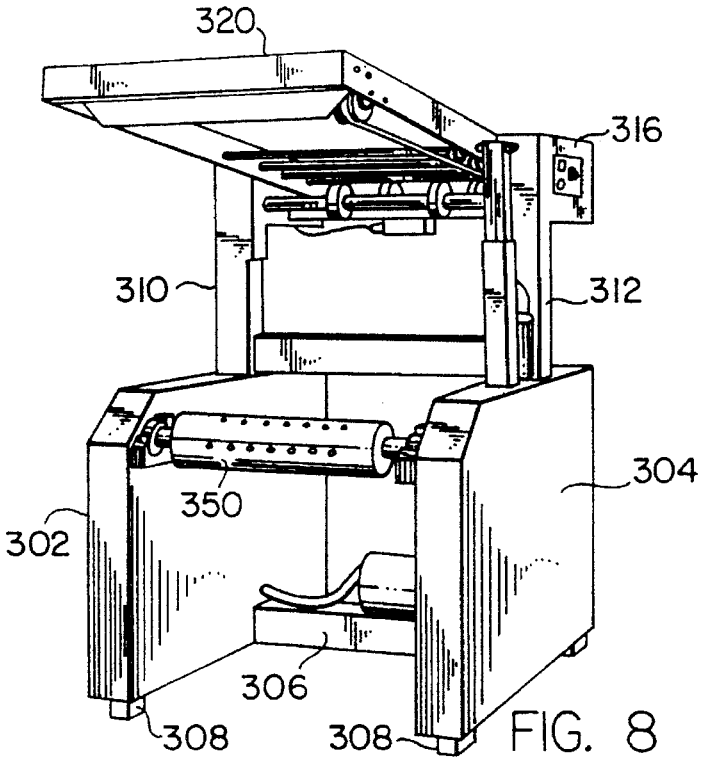
FIG. 8 is a perspective view taken from the forward left side of the rewind machine.
Figure 9:
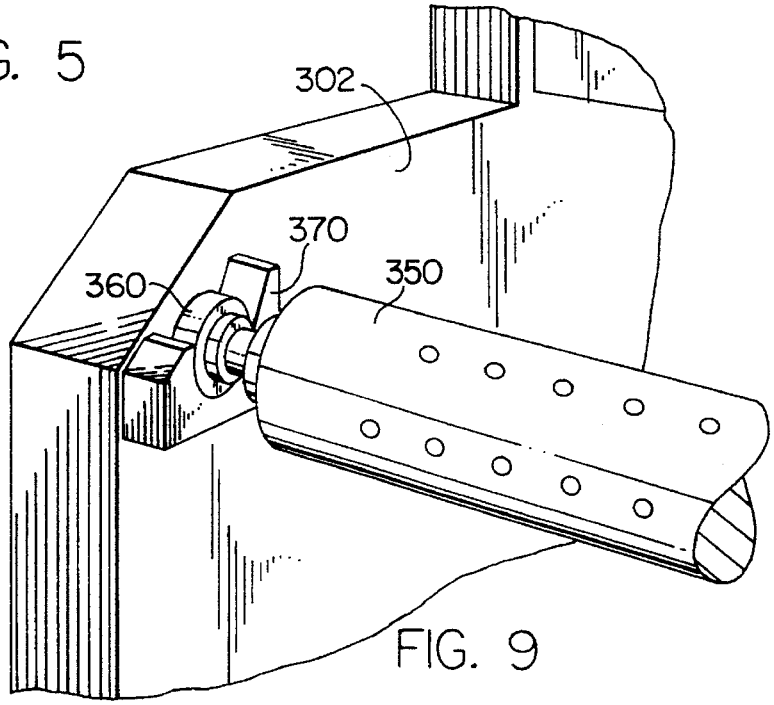
FIG. 9 is a detailed view taken from the same vantage point of that of FIG. 8 illustrating the support for one end of the pneumatic roll core shaft in the rewind machine. The roll core shaft in turn supports the paper roll (not shown).

The frames for both the unwind machine 200 and the rewind machine 400 are of similar construction and FIGS. 8 and 9 illustrate in perspective the overall configuration for these frames. These frames include a base portion defined by vertically extending side walls 302 and 304 oriented in laterally spaced relationship relative to one another, and a lower cross beam 306 that supports the lower edges of the vertically extending side walls. Each side wall 302 and 304 is fabricated of a hollow steel box construction with welded up edge walls, and feet 308, 308 are provided at the lower edge of each vertically extending side wall.

Still with reference to the frame, upright supports 310 and 312 have cantilevered arms 314 and 316 at their upper ends. The upper ends of these upright supports 310 and 312 also provide pivotal support for a pivotably support beam 320 that houses the drive means for the paper roll 12 in the unwind and the roll 16 in the rewind machine. These paper rolls typically have a cardboard core, and this core is of a known internal diameter so as to receive a pneumatic roll core shaft of the type indicated generally at 350 in FIGS. 8 and 9. The roll core shaft 350 includes radially extendible gripping plugs that are pneumatically operated to grip the core of the paper roll. The end portions of the roll core shaft carry roller bearings as indicated generally at 360. The outer race of each roller bearing is adapted to be received in a U-shaped socket as indicated generally at 370 in FIG. 9.

In operation the paper roll 12 in the unwind machine 200 is provided with the roll core shaft, and then lifted into position in the machine by a hydraulic cart or the like. The paper web is then threaded from the roll 12 in FIG. 2 though a series of guide rollers and wheels so as to form a tensionless free loop, such as indicated generally at 14*a* in FIG. 2, for delivery to the laser printer in the direction indicated at the left hand side of FIG. 2.

Figure 3:
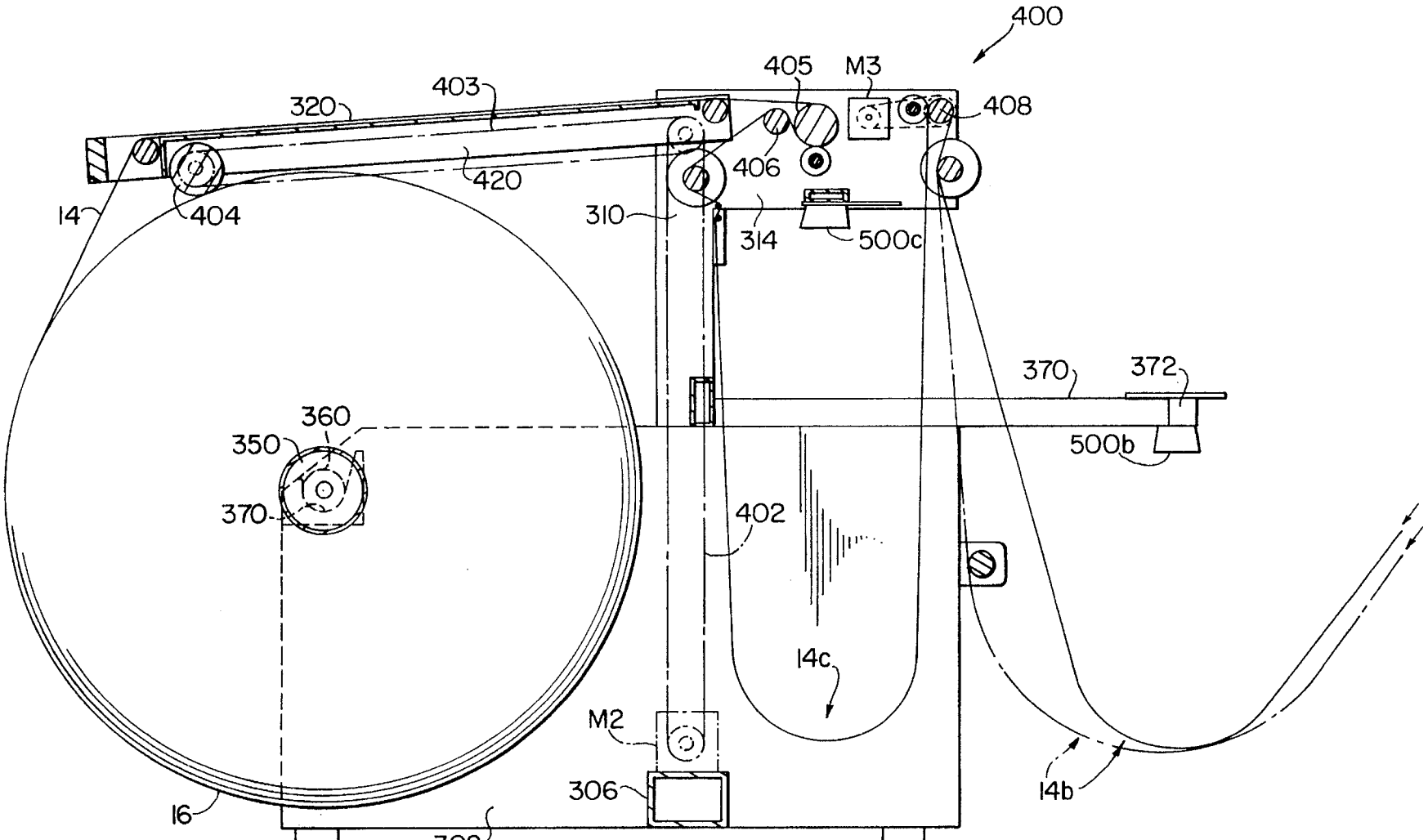
FIG. 3 shows in vertical elevation the rewind machine illustrated in FIG. 1, the phantom line in this view illustrating the paper web restrained by a guide bar provided in the rewind machine frame, and in the solid line view without such a restraint.

Similarly, and as shown in FIG. 3, the rewind machine 400 is adapted to receive the web of paper from the laser printer as indicated generally the arrows at the right hand side of FIG. 3 with the guide rollers and backup wheels as well as a drag roller 405 being provided for forming two tension free loops as indicated generally at 14*b* and 14*c* in FIG. 3 with the result that the paper is wound on the roll 16 by the rewind machine 400.

DETAILED DESCRIPTION OF UNWIND MACHINE (FIGS. 2, 4 AND 7)

Figure 2:
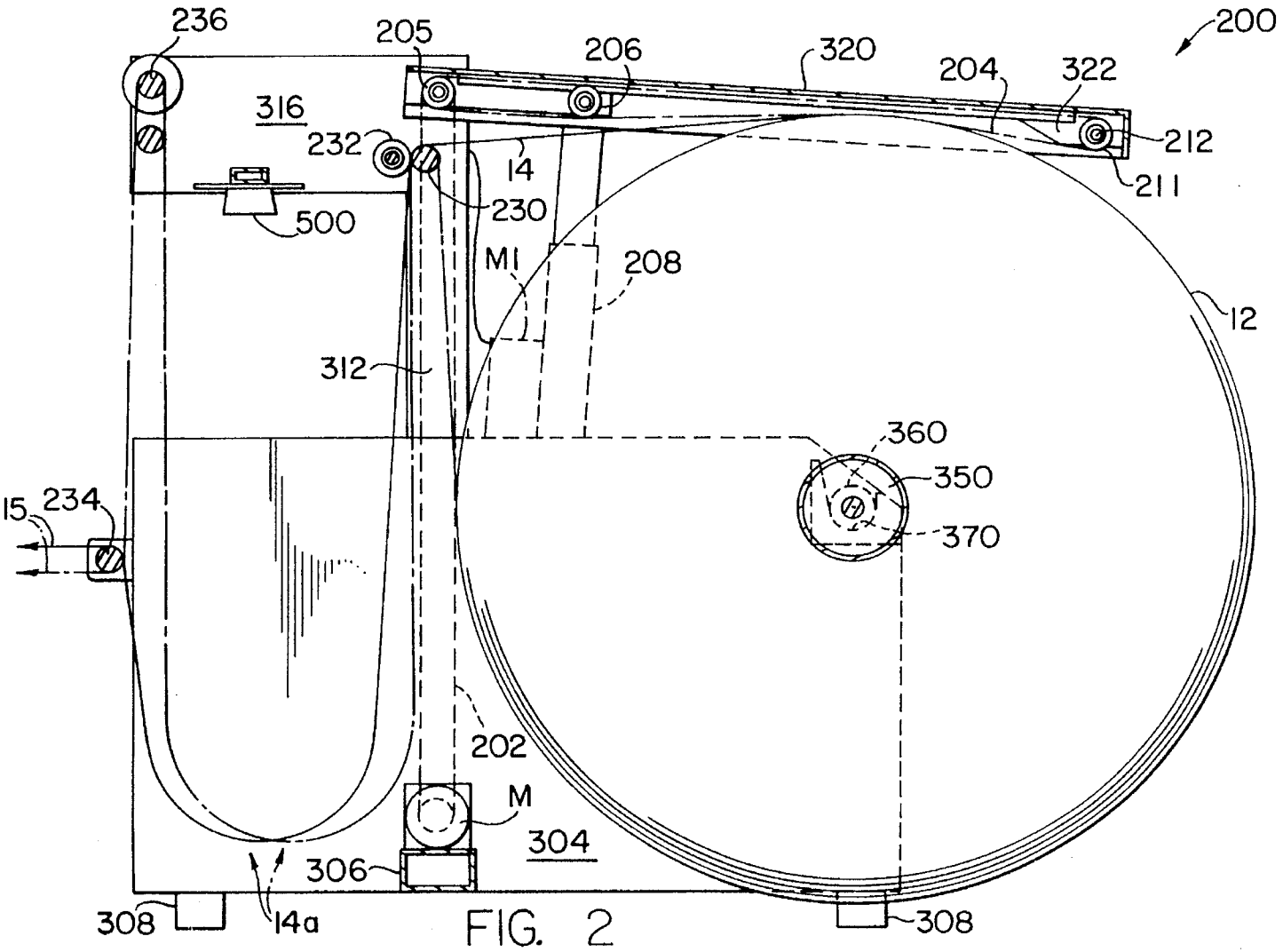
FIG. 2 shows in vertical section the unwind machine of FIG. 1 with the web of paper withdrawn from the top of the roll of paper. The phantom lines show the result of reversing the direction of rotation of the roll so that the paper web is drawn from the underside of the roll of paper.
Figure 4:
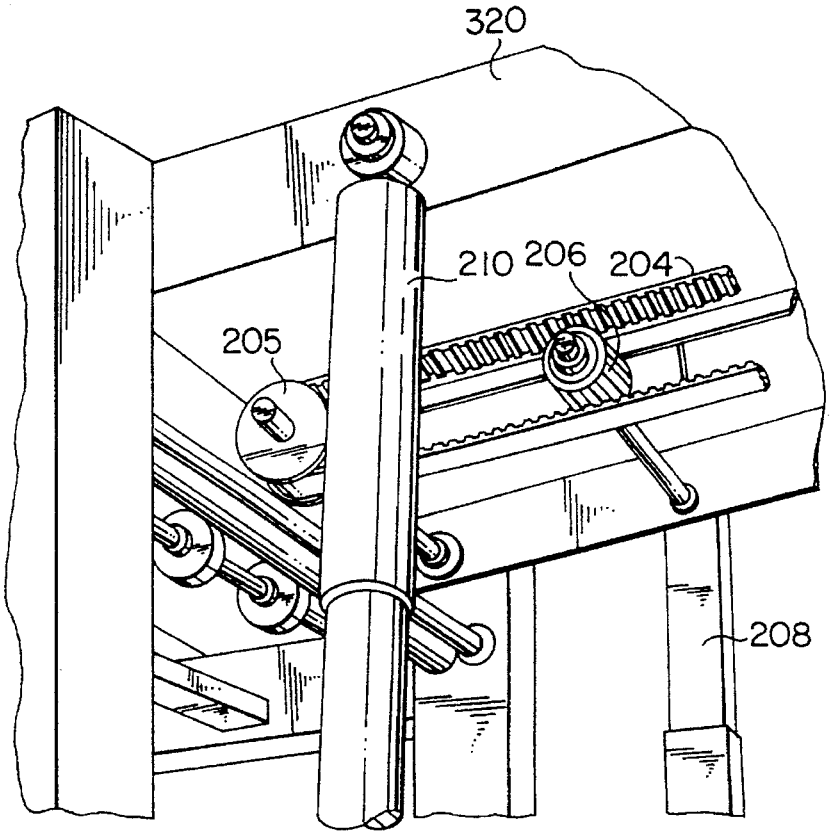
FIG. 4 is a perspective view looking upwardly under the pivoted end of the support beam for the conveyor belt in the unwind machine.

Turning now to FIG. 2 in greater detail, the roll of paper being unwound 12 is supported on a pneumatic roll core shaft 350 by means of roller bearings 360 provided at the ends of the roll core shaft. Each roller bearing 360 has its outer race contained in a U-shaped socket 370 provided for this purpose on the inside of each vertical side wall 302 and 304. An electric motor M is provided on the cross beam 306 of the machine frame, and the motor M operates, through a variable speed drive, to rotate the paper roll 12 through a vertically extending drive belt 202 and a drive belt 204 provided in the pivotably supported beam 320 that is mounted to the upper ends of the vertically extending uprights 310 and 312. A sprocket 205 is provided at the pivot axis of the pivotably supported beam 320. An idler sprocket 206 maybe provided in the pivotably supported beam 320 to aid in supporting the lower run of this 204, which belt is preferably in the form of a timing belt (that is having ribs that cooperate with teeth on the pulleys or sprockets that support it). FIG. 4 shows the drive belt 204 and also shows the backup wheel or sprocket 206 just described. The pivotably supported beam 320 that carries the drive belt 204 is normally biased by gravity against the periphery of the paper roll 12, but can be raised away from the roll by a jack screw provided inside the telescoping tube structure indicated at 208. The jack screw is driven by a reversible electric motor M1 best shown in FIG. 2. As best shown in FIG. 4 a shock absorber 210 is provided on the opposite side of the pivotably supported beam 320 from the telescoping tube structure 208 so as to prevent the drive belt 204 and the pivotably supported beam 320 from bouncing on the roll of paper 12 during the occasionally severe unwind conditions created by the intermittent speeds characteristic of laser printers.

Figure 6:
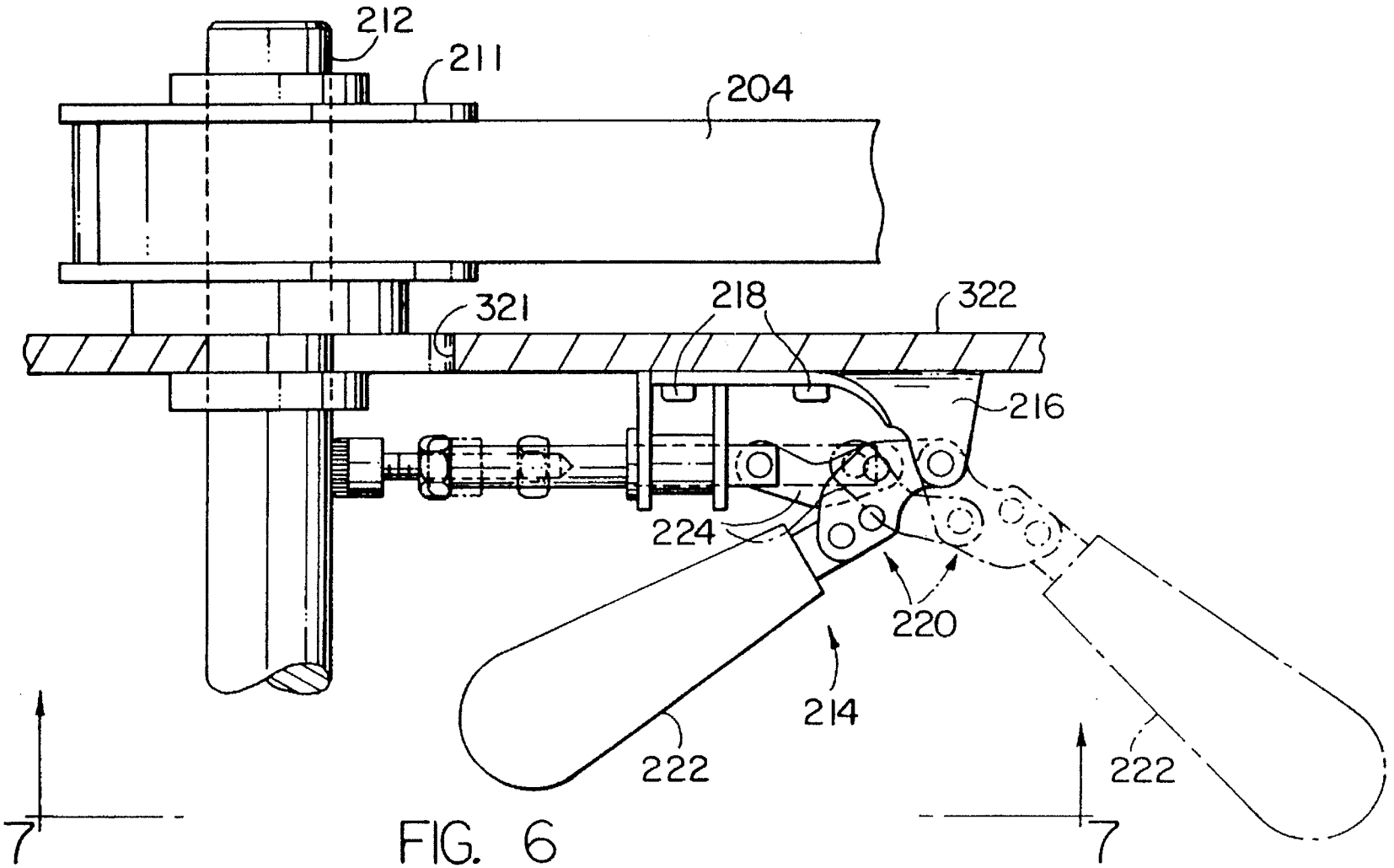
FIG. 6 is a detailed view of the outboard end of the conveyor belt illustrated in FIG. 5 showing the two position latch for releasing the outboard end sprocket to facilitate changing the belt (the release position is shown in phantom).
Figure 7:
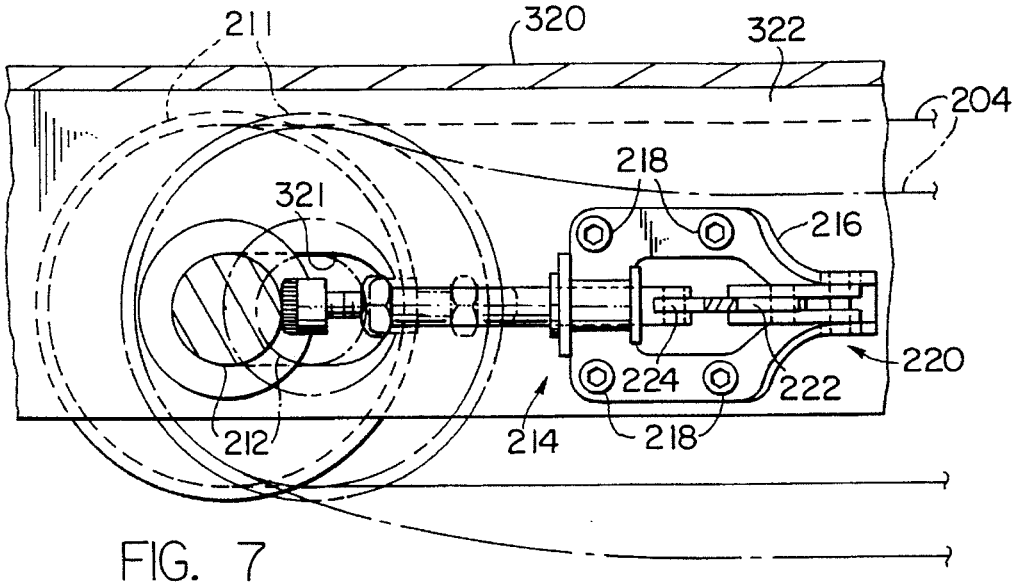
FIG. 7 is a side view taken on the line 7—7 of FIG. 6.
Figure 5:
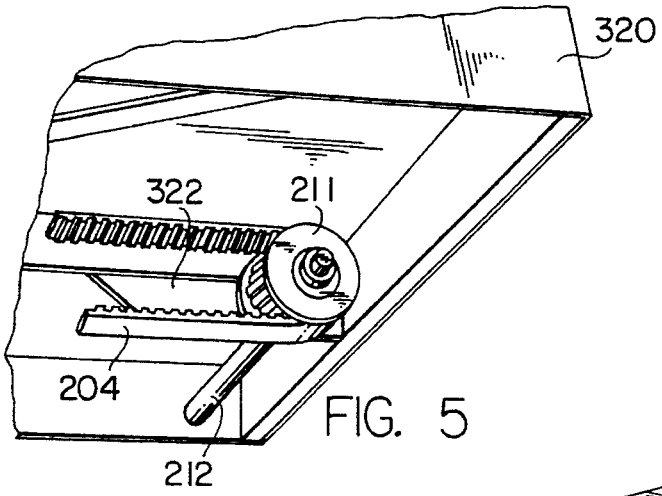
FIG. 5 is a view from the same vantage point as FIG. 4 illustrating the opposite end of the conveyor belt.

At the outboard end of the pivotably support beam 320 an idler sprocket 211 is provided for the drive belt 204. An important feature of the present invention in the unwind machine 200 is the ability to readily remove, for replacement, this drive belt 204. FIGS. 6 and 7 show the mechanism for accomplishing this task in detail. A stub shaft 212 for the outboard sprocket 211 is slidably supported in a slot 321 provided for this purpose in a plate 322 in the pivotably supported beam 320. The shaft 212 is normally held in the solid line position shown for it in FIGS. 6 and 7 by a plunger structure 214 oriented at right angles to the axis of the stub shaft 212. The plunger structure 214 is slidably mounted in a bracket 216 secured to the plate 322 by screws 218. An over center latch 220 is provided with a handle 222 and bellcrank 224 such that movement of the latch handle from the solid line position shown in FIGS. 6 and 7 to the phantom line position shown allows the stub shaft 212 to move out of its active position as shown in full lines to a position where the slack belt 204 can be readily removed from the sprocket 211 (See FIG. 7).

The unwind machine of FIG. 2 can be used to draw paper web from the bottom of the paper roll, as indicated generally by the phantom lines for the web material in that view, or can instead be configured for withdrawing the web from the top of the paper roll as illustrated in full lines in FIG. 2. Considering first the full line configuration the paper web passes over a roller 230 which may be driven directly from the motor M provided on the cross beam 306 at a sufficient speed to maintain tension in the web 14 between the driven belt 204 and itself. Alternatively the roller 230 is driven by an independent electric motor at a speed sufficient to provide some slippage between the web material and the roller 230 in order to create a slight tension in the paper web between this driven roller 230 and the paper roll being unwound.

Backup wheels 232 are provided to maintain contact between the paper web and the tension roller 230. The paper web thereafter forms a tensionless free loop, as indicated generally at 14*a*, the web passing over a guide bar or roller 234 provided at a height to permit feeding of the web material into the laser printer as suggested generally by the arrow 15 at the end of the web 14. Alternatively, where the web is to be withdrawn from the lower side of the paper roll 12 as a result of rotating paper roll 12 in the opposite direction, the same tension roller 230 is provided so that the web travels over it and over a roller 236 provided at the upper end of the cantilevered arm 316, whence the web drops downwardly and passes around the guide bar 234 referred to previously, for entry into the laser printer. An ultrasonic detector 500 is provided for sensing the displacement between it and the lower portion of the tension free loop 14*a* in order to provide input to a control circuit that regulates the speed of the motor M which operates the driven belt 204. The control circuitry provided for using the signal from the ultrasonic detector for this purpose is well known, and the reader is referred to U.S. Pat. No. 4,384,665 issued to Waddington in 1983 for a more detailed description of such control circuitry in general.

DETAILED DESCRIPTION OF REWIND MACHINE (FIGS. 3 AND 10)

Turning now to the rewind machine of FIG. 3, the paper roll 16 is being rewound as the paper web is fed onto the roll 16 from the laser printer 10. A urethane coated drive roller 404 is driven from a motor M2 provided on the cross brace 306 of the machine frame for this purpose. A vertically extending drive belt 402 is operated through a variable speed drive for this purpose. A second drive belt 403 is provided at one side of the pivotably supported beam 320 to so operate the urethane coated roller 404. Tension is provided in the paper web 14 as it is being wound on the roll 16 by a second urethane coated roller 405 provided in the arms 314, 316 which are cantilever mounted to the uprights 310 and 312 in the machine frame. A drag brake is provided for this roller 405 and the drag brake is electrically controlled for impeding rotation of this roller 405 so as to create a drag on the web and thereby produce the desired tension in the web between the roller 405 and the rewind roll 16. This friction or drag roller 405 also provides a mechanism for the tension free loop 14*c* and the depth of this loop is continually sensed by an ultrasonic detector 500*c*.

While a single such tension free loop 14*c* and ultrasonic detector 500*c* might be suitable for some purposes, with the present state of technology in laser printers generally, and in order to meet the future requirements of other utilization devices such as slitters, and other equipment, means is provided for forming an additional tension free loop 14*b* between the rewind machine 400 and the utilization device. In order to form this second loop a small torque motor M3 is provided to drive a roller 408 associated with the downstream end of this second loop 14*b*. Another ultrasonic detector 500*b* is provided on a beam 370 mounted for this purpose in the machine frame. The beam 370 is mounted at one side of the machine on a short cantilevered cross beam 372. The depth of this loop 14*b* is monitored by the ultrasonic detector 500*b*.

Still with reference to the urethane roller 405 associated with creating the tension between itself and the rewind roll 16, it is a feature of the present invention that an idler roller 406 is provided adjacent to the roller 405 so as to provide a 270 degree wrap of the paper web around the urethane roller 405. Significant tension must be provided in the web between the urethane roller 405 and the rewind roll 16 so that it is important to provide this degree of wrap on the urethane roller 405. As a result of this web wrap under tension the roller 405 can become worn as a result of the continuous slippage necessarily incorporated into the design between itself and the paper web. When worn the roller 405 must be removed for replacement or repair by the machine operator. This can lead to significant downtime in the machine, and it is a feature of the present invention that means is provided for conveniently removing this urethane drag or friction roller 405.

Figure 10:
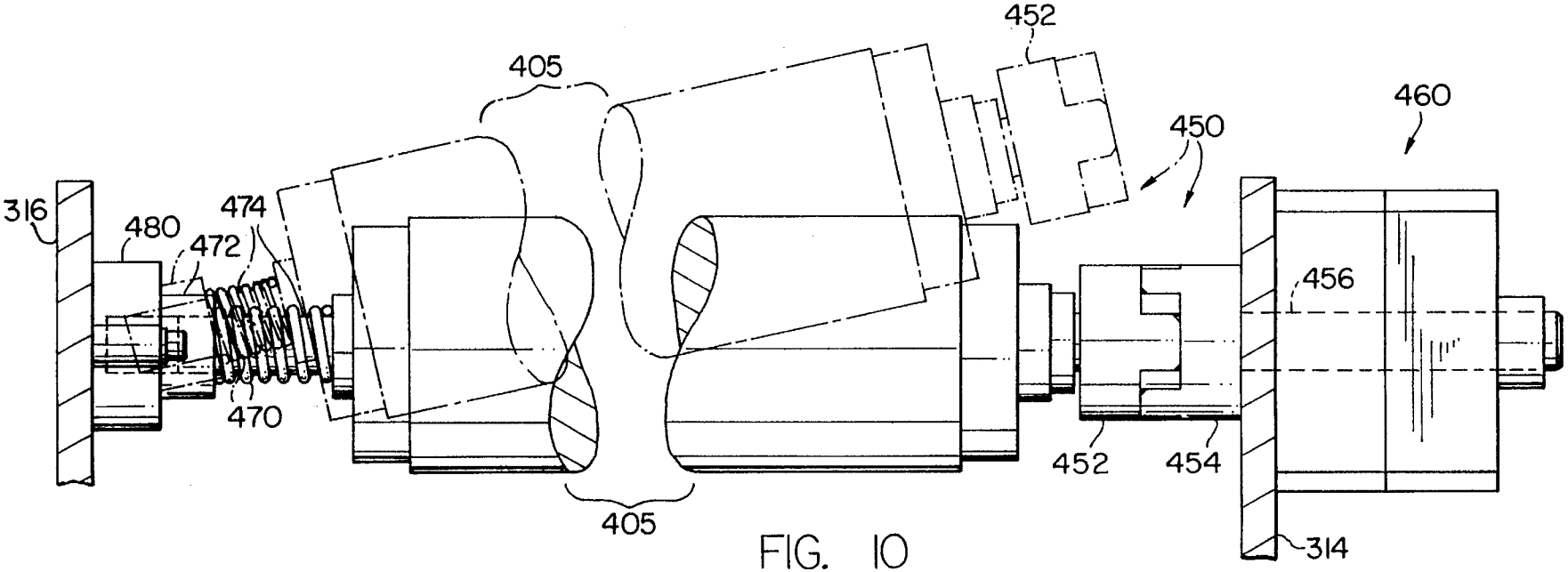
FIG. 10 is an elevational view of the drag or friction roller provided in the rewind machine for creating tension in the paper web between the tension free loop and the paper roll being rewound. The phantom line position for the drag roller illustrates roller in the process of being removed for replacement or repair.

Referring now to FIG. 10, the urethane roller 405 is shown mounted between the arms 314 and 316 in the machine frame. The urethane coated roller 405 has opposed ends provided with unique attachment means that permit its quick removal for replacement, and hence provides for the minimization of the down time in the rewind machine itself. Referring particularly to the right hand end portion of this drag roller 405 an axially separable coupling 450 is provided with one portion 452 on the end of the roller 405, and the other portion 454 that mates with it provided on a shaft 456. This shaft 456 is journalled in the plate 314 and an electromagnetic drag brake assembly 460 is provided to exert a drag force or torque on the urethane coated roller 405.

In order to permit separation of the coupling components 452 and 454 the left hand end of the roller 405 includes a spring 470 provided around a stub shaft 474 at the left hand end of the roller 405. This spring acts between the end of the roller 405 and a collar 472 secured to the shaft 474. The shaft 474 has an end portion that is axially movable toward the left in a recess defined for this purpose in the journal bearing 480. The journal bearing is mounted to the arm structure 316 by screws as shown, and the journal bearings also provides for limited angular movement of the shaft 474 and the roller 405 when the spring 474 is compressed so as to allow separation of the flexible coupling components 452 and 454 described previously. FIG. 10 shows in phantom lines the urethane coated roller 405 with the spring having been compressed and with the flexible coupling components separated so as to permit withdrawing the entire assembly from the socket defined at the left hand journal bearing 480.

DETAILED DESCRIPTION OF FIG. 11

Figure 11:
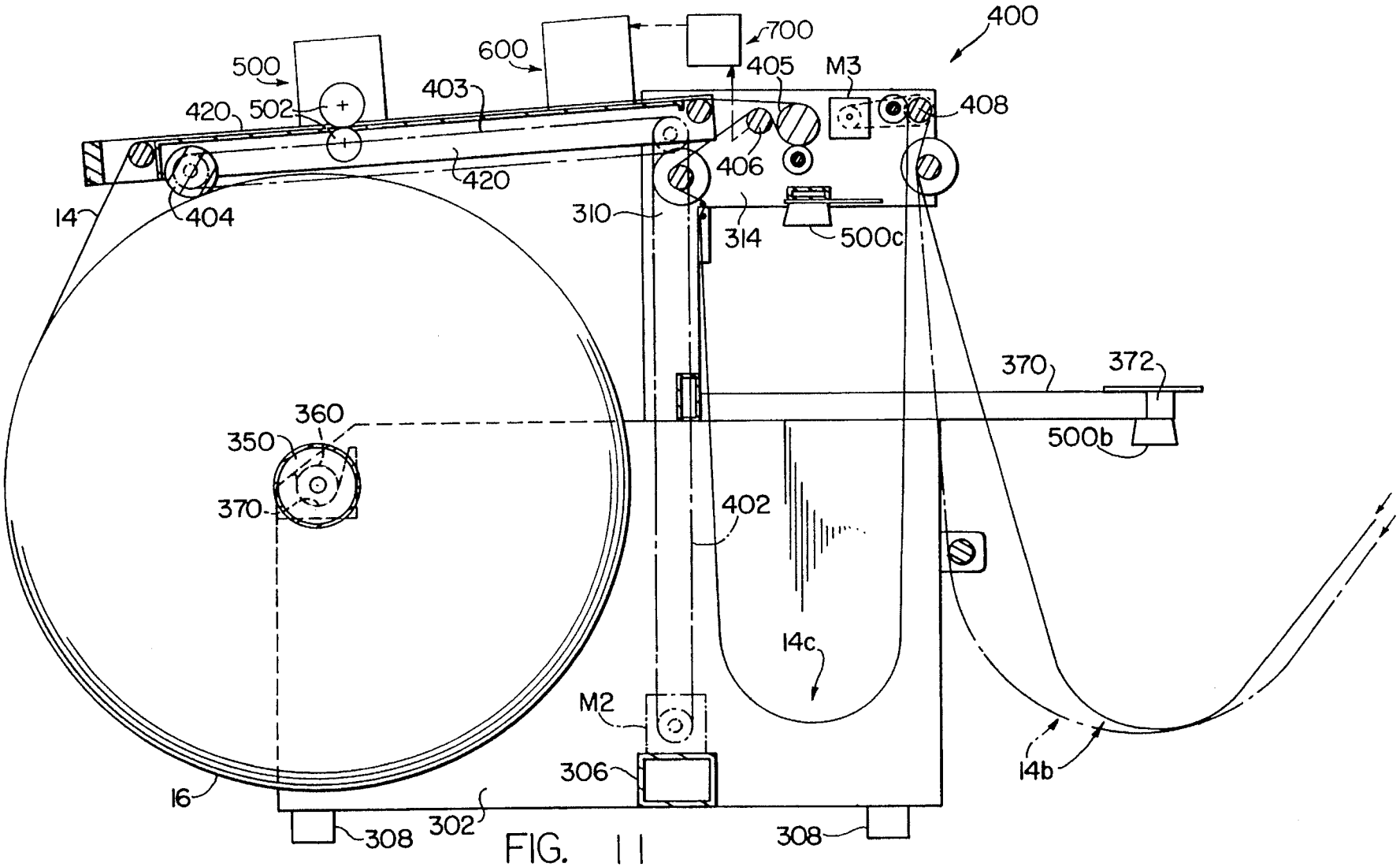
FIG. 11 is a view similar to FIG. 3 illustrating the rewind machine provided with improvements on the pivoted beam that carries the driven roll for rotating the rewind roll itself. These devices are provided atop the beam adjacent the straight run of web material traveling across the top of the pivoted beam.

FIG. 11 shows the rewind machine of FIG. 3 fitted with improvements in accordance with the present invention. Identical components are illustrated by the same reference numerals as used in connection with the description of FIG. 3. However, the roll 406 in FIG. 11 preferably includes an encoder, the output of which encoder is fed to a controller 700. The controller uses this information from the web material in order to control selectively the operation of a printer 600 and/or a slitter 500.

Both the slitter 500 and the printer 600 are mounted on the pivoted beam 420 which carries the driven urethane roller 404 that rotates the roll of paper in the rewind machine. The slitter 500 may be of conventional construction and of the type currently available in the trade. The slitter is indicated schematically as including counter rotating slitter wheels 502 which slit the paper web material into any number of individual paper webs for rewinding on the same roll as shown, or for rewinding on separate rolls and/or feeding to other adjacent machines (not shown) capable of folding or rolling of these individual paper webs.

The printer 600 is driven selectively from the controller 700 to apply individualized indicia on the paper web traveling past the printer 600 along the upper run of the web material as it travels across the top of the beam 420. The rewind machine in FIG. 11 is otherwise similar to the rewind machine described previously, and the description of the rewind machine itself will not be repeated here as the machine has been adequately described in my original application Ser. No. 218,512 now U.S. Pat. No. 5,505,401, upon which this continuation-in-part application is based.

I claim:

1. Machine for manipulating web material between a roll of the web material and a utilization device, said machine comprising, a frame, a beam pivotally supported in said frame, a driven member rotatably supported in said beam and engageable with said roll to rotate the roll, web guiding means for the web material moving between the utilization device and the roll, said web guiding means including web supporting surfaces on said beam to provide a generally straight run of web material across the top of said beam, and means mounted on said beam for working on the web material as the web material travels along said straight run.

2. The combination according to claim 1 wherein said means for working on the web material comprises a slitter.

3. The combination according to claim 1 wherein said means for working on the web material comprises a printer.

4. The combination according to claim 3 further characterized by encoder means for tracking the travel of the web material, and said encoder means coupled to said printer for selective printing of said traveling web material.

5. The combination according to claim 4 wherein said means for working on the web material further comprises a slitter also mounted on said pivoted beam.

* * * * *

UNITED STATES PATENT AND TRADEMARK OFFICE

CERTIFICATE OF CORRECTION

PATENT NO. : 5,617,134

DATED : April 1, 1997

INVENTOR(S) : Richard P. Lamothe

It is certified that error appears in the above-indentified patent and that said Letters Patent is hereby corrected as shown below:

Column 5

Line 19, the second occurrence of the word "support" should be "supported".

Column 6

Line 18, the word "support" should be "supported".

Signed and Sealed this

Twentieth Day of May, 1997

*Attest:*

*Attesting Officer*

Bruce Lehman

BRUCE LEHMAN

*Commissioner of Patents and Trademarks*